US007175295B2

(12) United States Patent
Bretz et al.

(10) Patent No.: US 7,175,295 B2
(45) Date of Patent: Feb. 13, 2007

(54) ADJUSTABLE FLASHLIGHT SUPPORTABLE ABOUT A USER'S NECK

(76) Inventors: Jeffrey A. Bretz, 22402 Englehardt, St. Claire Shores, MI (US) 48080; Andrea Thomas, 21914 Maxine St., St. Claire Shores, MI (US) 48080

( * ) Notice: Subject to any disclaimer, the term of this patent is extended or adjusted under 35 U.S.C. 154(b) by 123 days.

(21) Appl. No.: 11/052,510

(22) Filed: Feb. 7, 2005

(65) Prior Publication Data

US 2006/0176680 A1 Aug. 10, 2006

(51) Int. Cl.
*F21V 21/32* (2006.01)
*F21L 4/02* (2006.01)
*F21L 4/04* (2006.01)

(52) U.S. Cl. ..... 362/108; 362/184; 362/190; 362/198; 362/238; 362/250; 362/251

(58) Field of Classification Search ..... 362/108, 362/184, 189, 190, 191, 197–199, 238, 239, 362/250, 251; D26/43, 62, 65
See application file for complete search history.

(56) References Cited

U.S. PATENT DOCUMENTS 1,825,088 A * 9/1931 Powell et al. ..... 362/108
2,506,685 A * 5/1950 Sadloski et al. ..... 362/108
2,555,871 A * 6/1951 Caggiano ..... 362/108
D268,442 S 3/1983 Darmon
4,739,801 A 4/1988 Kimura et al.
5,128,843 A * 7/1992 Guritz ..... 362/108
5,521,803 A 5/1996 Eckert et al.
5,567,115 A 10/1996 Carbone
5,702,175 A 12/1997 Chen
5,717,276 A 2/1998 Hsu
5,741,062 A 4/1998 Man
D394,721 S 5/1998 Santarsiero
5,749,644 A 5/1998 Carbone
5,906,426 A 5/1999 Farrington et al.
D413,175 S 8/1999 Kaiser et al.
6,004,004 A 12/1999 Altman et al.
6,095,657 A * 8/2000 Kent ..... 362/108
6,106,130 A * 8/2000 Harding ..... 362/108
6,280,050 B1 8/2001 Bird et al.

* cited by examiner

*Primary Examiner*—Alan Cariaso

(57) ABSTRACT

A hands-free apparatus for illuminating an area surrounding a user's body includes a plurality of flexible tubes having mateable proximal end portions and spaced distal end portions positionable at a predetermined spatial relationship disposed forwardly of the proximal end portions. A power supply source is internally situated within the flexible tubes. A plurality of light-emitting sources are connected to the flexible tubes and electrically coupled to the power supply source respectively. The light-emitting sources each include a switch operably connected to the power supply sources such that a user may independently toggle each light-emitting sources between operating and non-operating modes. The switches are preferably connected to a plurality of housings encasing the light-emitting sources and are positioned distal to a maintaining mechanism medially attached to the flexible tubes.

15 Claims, 3 Drawing Sheets

ADJUSTABLE FLASHLIGHT SUPPORTABLE ABOUT A USER'S NECK

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to lighting devices and, more particularly, to an adjustable flashlight supportable about a user's neck.

2. Prior Art

Portable light devices generally provide a source of light in areas where it is not convenient or possible to use a light device powered by a source of electricity such as from an electrical outlet of a home or building. A common type of portable light device, generally known as a "flashlight" is powered by one or more batteries. These devices generally have a light bulb portion at one end connected to an elongated handle portion for housing one or more batteries. Variations have been developed over the years in the general structure of the common portable flashlight device as described above.

One recent variation, sold under the trademark "The Snake" by Black & Decker Inc. of Newark, Del., provides a flexible flashlight having a light bulb at one end, a compartment for one or more batteries at the opposite end and an elongated flexibly deformable handle disposed therebetween having conductor means disposed therein for electrically connecting the light bulb portion with the battery compartment. The deformable handle which apparently employs a flexible assembly of connectors and can be wrapped around an object for retaining the flexible flashlight in a desired position.

A problem exists, however, with these prior art portable light devices in that none of them appear to satisfy a need for more than one beam of light in areas where a source of electricity is not readily available and where it is desirable to have a device providing more than one beam of light with each light beam being easily movable in relation to the other light beam. Also, a problem appears to exist particularly with the above-described prior art device having the elongated flexible handle in that the electrical connection which is disposed within the handle is vulnerable to being damaged upon flexing of the handle.

Accordingly, a need remains for an adjustable flashlight supportable about a user's neck and emanating multiple beams of light to overcome the above noted shortcomings. Such a flashlight would allow an individual to carry the flashlight around his or her neck and would benefit a wide variety of individuals such as contractors and do-it-yourselfers who need such a hands-free light to accomplish their tasks. Such a flashlight would be relatively lightweight, easy to use, convenient, and capable of illuminating a dark area without having to be held or positioned.

BRIEF SUMMARY OF THE INVENTION

In view of the foregoing background, it is therefore an object of the present invention to provide an adjustable flashlight supportable about a user's neck. These and other objects, features, and advantages of the invention are provided by a hands-free apparatus for illuminating an area surrounding a user's body. Such an apparatus includes a plurality of pliable and resiliently tubes having removably matable proximal end portions and distal end portions positionable at a predetermined spatial relationship disposed forwardly of the proximal end portions. The tubes are adaptable between arcuate and linear shapes such that the apparatus can be adjustably positioned about a user's neck and supported thereon during operating conditions.

A replaceable power supply source is internally situated within the flexible tubes. The power supply source includes a protective cover having detachably mated first and second portions such that a user may advantageously readily access and replace the power supply source during repeated use.

A plurality of light-emitting sources are connected to the flexible tubes and electrically coupled to the power supply sources respectively. The light-emitting sources each include a switch operably connected to the power supply sources such that a user may independently toggle the light-emitting sources between operating and non-operating modes. The switches are preferably connected to the housings and are preferably positioned distal to the maintaining means.

The light-emitting sources preferably include a plurality of housings including a plurality of transparent lenses attached thereto for allowing a path of light to emanate outwardly from the apparatus. Each such housing is selectively positionable distally of the maintaining mechanism for allowing each of the housings to be independently angled along a plurality of quadrants.

The apparatus includes a mechanism for maintaining the distal end portions at the fixed spatial relationship after the flexible tubes are positioned about the user's neck such that a user may alter a position of the apparatus by moving the user's shoulders without the need to handle the flexible tubes. The maintaining mechanism extends medially between the distal end portions and is positioned forwardly of the user's neck so that the user can visually identify a position of the distal end portions and quickly detach the flexible tubes from the maintaining mechanism.

The maintaining mechanism preferably includes an elongated bracket having a centrally disposed longitudinal axis extending along a horizontal plane and further having opposed end portions removably connected to the flexible tubes respectively. Each such bracket end portion preferably has a substantially arcuate shape for receiving the distal tube end portions therein such that the flexible tubes can be moved laterally and outwardly away from the bracket when a user wishes to remove the apparatus from an operating position.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
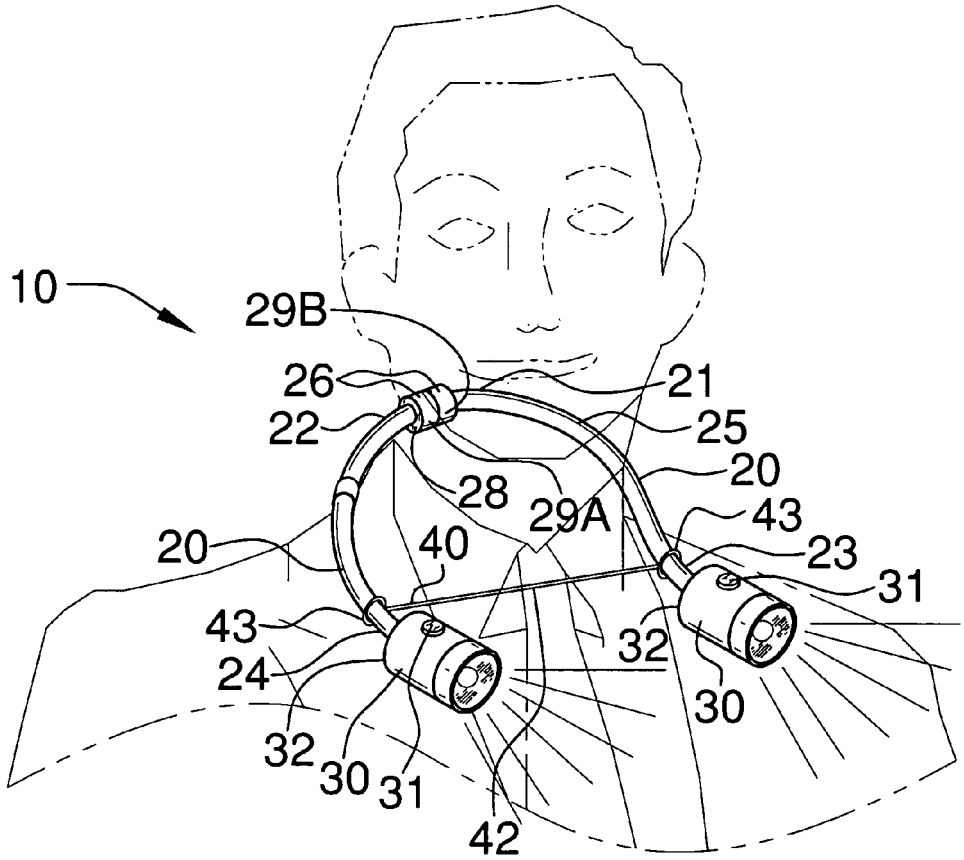
FIG. 1 shows a perspective view of an adjustable flashlight supportable about a user's neck, in accordance with the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this application will be thorough and complete, and will fully convey the true scope of the invention to those skilled in the art. Like numbers refer to like elements throughout the figures and prime and double prime numbers refer to like elements in alternate embodiments.

The apparatus of this invention is referred to generally in FIGS. 1–4 by the reference numeral 10 and is intended to provide an adjustable flashlight supportable about a user's neck. It should be understood that the apparatus 10 may be used in many different applications and should not be limited to only those applications requiring hands-free use and illumination of the area surrounding a user's body.

Figure 2:
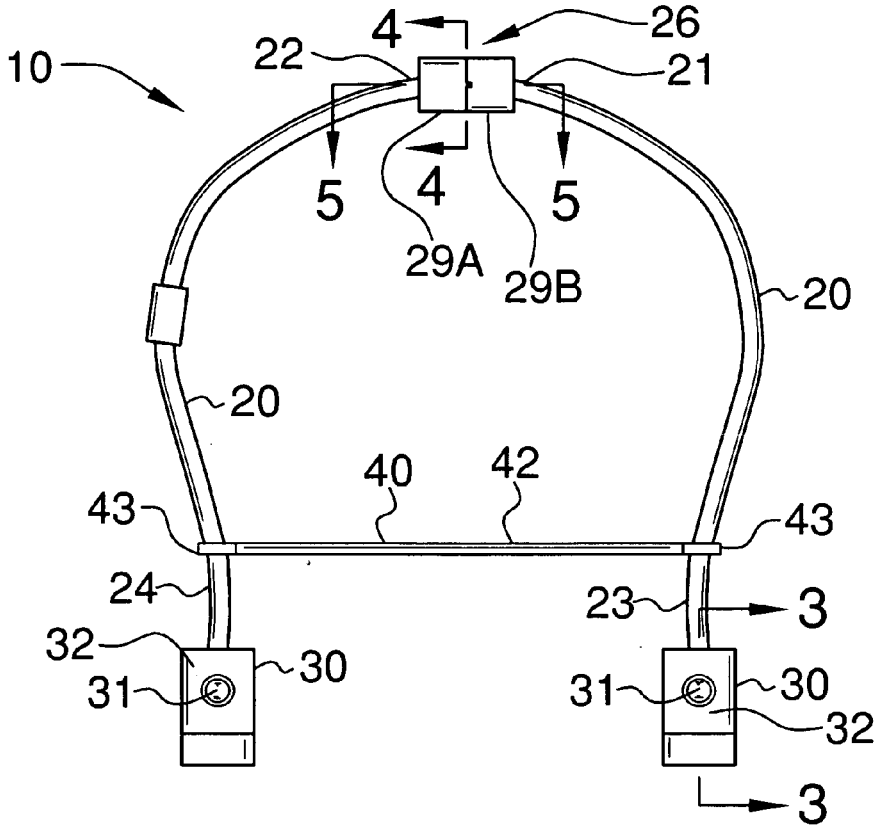
FIG. 2 shows a top plan view of the present invention shown in FIG. 1.

Referring initially to FIGS. 1 and 2, the apparatus 10 includes a plurality of pliable and resiliently deformable tubes 20 having removably matable proximal end portions 21, 22 and spaced distal end portions 23, 24 positionable at a predetermined spatial relationship and disposed forwardly of the proximal end portions. The tubes 20 are adaptable between arcuate and linear shapes such that the apparatus 10 can be adjustably positioned about a user's neck and supported thereon during operating conditions. The pliable and resilient nature of the tubes 20 advantageously allows the user to conform the tubes 20 to a general shape of their neck for a comfortable and secure fit.

Referring to FIGS. 1 through 5, a replaceable power supply source 26 is internally situated within the flexible tubes 20. The power supply source includes a protective cover 28 having detachably mated first 29A and second 29B portions such that a user may advantageously readily access and replace the power supply source 26 during repeated use. Such a replaceable power supply source 26 may, of course, include a plurality of batteries 27 as is well known to an individual of ordinary skill in the art.

A plurality of light-emitting sources 30 are connected to the flexible tubes 20 and electrically coupled to the power supply sources 26 respectively. The light-emitting sources 30 each include a switch 31 operably connected to the power supply sources 26 such that a user may independently toggle the light-emitting sources 30 between operating and non-operating modes. The switches 31 are connected to the housings 32 (described herein below) and are positioned distal to the maintaining mechanism 40 (described herein below). Such a positioning of the switches 31 advantageously allows a user to easily activate or deactivate either light-emitting source 30 as their needs may require, thus improving the versatility of the apparatus 10.

Figure 3:
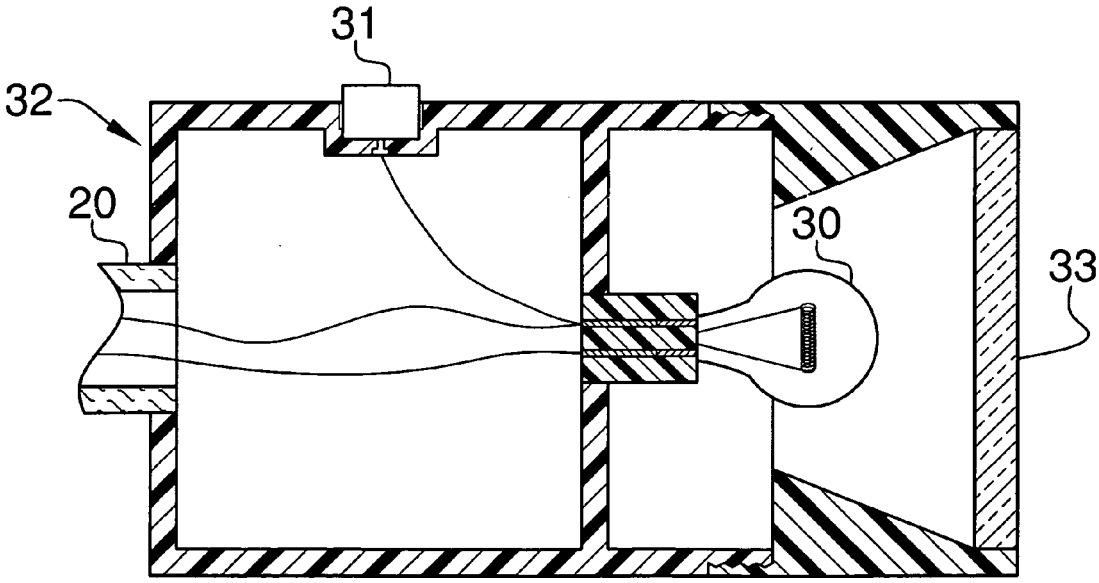
FIG. 3 shows an enlarged cross-sectional view of a light emitting source situated within an associated housing.
Figure 4:
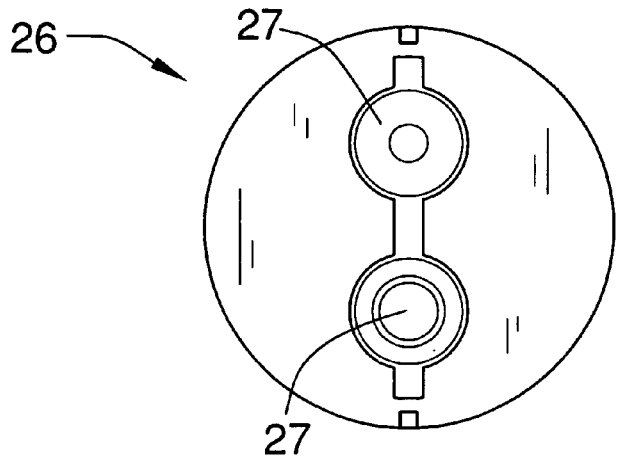
FIG. 4 shows an enlarged end view of the power supply source, taken along line 4—4.
Figure 5:
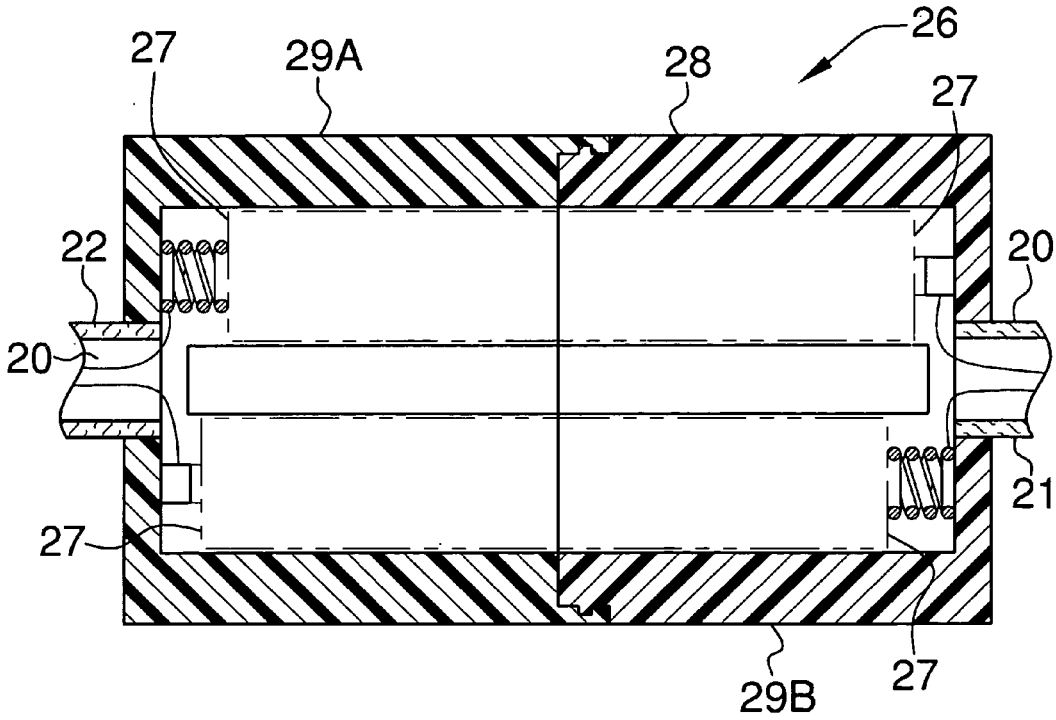
FIG. 5 shows an enlarged cross-section view of the power supply source shown in FIG. 4.

Referring to FIGS. 1, 2 and 3, the light-emitting sources 30 include a plurality of housings 32 including a plurality of transparent lenses 33 attached thereto for allowing a path of light to emanate outwardly from the apparatus 10. Each such housing 32 is selectively positionable distally of the maintaining mechanism 40 for allowing each of the housings 32 to be independently angled along a plurality of quadrants.

Referring to FIGS. 1 and 2, the apparatus 10 includes a mechanism 40 for maintaining the distal end portions 23, 24 at the fixed spatial relationship after the flexible tubes 20 are positioned about the user's neck such that a user may alter a position of the apparatus 10 by moving the user's shoulders without the need to handle the flexible tubes 20. The maintaining mechanism 40 extends medially between the distal end portions 23, 24 and is positioned forwardly of the user's neck so that the user can visually identify a position of the distal end portions 23, 24 and quickly detach the flexible tubes 20 from the maintaining mechanism 40.

Still referring to FIGS. 1 and 2, the maintaining mechanism 40 includes an elongated bracket 42 having a centrally disposed longitudinal axis extending along a horizontal plane and further has opposed end portions 43 removably connected to the flexible tubes 20 respectively. Each bracket end portion 43 has a substantially arcuate shape for receiving the distal tube end portions 23, 24 therein such that the flexible tubes 20 can be moved laterally and outwardly away from the bracket 42 when a user wishes to remove the apparatus 10 from an operating position.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A hands-free apparatus for illuminating an area surrounding a user's body, said apparatus comprising:

a plurality of flexible tubes having removably matable proximal end portions and distal end portions positionable at a predetermined spatial relationship disposed forwardly of said proximal end portions, said tubes being adaptable between arcuate and linear shapes such that said apparatus can be adjustably positioned about a user's neck and supported thereon during operating conditions;

a power supply source internally situated within said flexible tubes;

a plurality of light-emitting sources connected to said flexible tubes and electrically coupled to said power supply source respectively, said light-emitting sources each comprising a switch operably connected to said power supply sources such that a user may independently toggle said light-emitting sources between operating and non-operating modes; and means for maintaining said distal end portions at the fixed spatial relationship after said flexible tubes are positioned about the user's neck such that a user may alter a position of said apparatus by moving the user's shoulders without the need to handle said flexible tubes, said maintaining means extending medially between said distal end portions and being positioned forwardly of the user's neck so that the user can visually identify a position of said distal end portions and quickly detach said flexible tubes from said maintaining means.

2. The apparatus of claim 1, wherein said light-emitting sources comprise:

a plurality of housings including a plurality of transparent lenses attached thereto for allowing a path of light to emanate outwardly from said apparatus, each said housing being selectively positionable distally of said maintaining means for allowing each said light-emitting sources to be independently angled along a plurality of quadrants.

3. The apparatus of claim 2, wherein said switches are connected to said housings and protrude upwardly therefrom respectively.

4. The apparatus of claim 2, wherein said switches are positioned distal to said maintaining means.

5. The apparatus of claim 1, wherein said maintaining means comprises:

an elongated bracket having a centrally disposed longitudinal axis extending along a horizontal plane and further having opposed end portions connected to said flexible tubes respectively, each said bracket end portion having a substantially annular shape for receiving said distal tube end portions therein such that said flexible tubes can be moved laterally and outwardly away from said bracket when a user wishes to remove said apparatus from an operating position.

6. A hands-free apparatus for illuminating an area surrounding a user's body, said apparatus comprising:

a plurality of pliable and resiliently deformable tubes having removably matable proximal end portions and distal end portions positionable at a predetermined spatial relationship disposed forwardly of said proximal end portions, said tubes being adaptable between arcuate and linear shapes such that said apparatus can be adjustably positioned about a user's neck and supported thereon during operating conditions;

a replaceable power supply source internally situated within said flexible tubes;

a plurality of light-emitting sources connected to said flexible tubes and electrically coupled to said power supply source respectively, said light-emitting sources each comprising a switch operably connected to said power supply sources such that a user may independently toggle said light-emitting sources between operating and non-operating modes; and means for maintaining said distal end portions at the fixed spatial relationship after said flexible tubes are positioned about the user's neck such that a user may alter a position of said apparatus by moving the user's shoulders without the need to handle said flexible tubes, said maintaining means extending medially between said distal end portions and being positioned forwardly of the user's neck so that the user can visually identify a position of said distal end portions and quickly detach said flexible tubes from said maintaining means.

7. The apparatus of claim 6, wherein said light-emitting sources comprise:

a plurality of housings including a plurality of transparent lenses attached thereto for allowing a path of light to emanate outwardly from said apparatus, each said housing being selectively positionable distally of said maintaining means for allowing each said light-emitting sources to be independently angled along a plurality of quadrants.

8. The apparatus of claim 7, wherein said switches are connected to said housings and protrude upwardly therefrom respectively.

9. The apparatus of claim 7, wherein said switches are positioned distal to said maintaining means.

10. The apparatus of claim 6, wherein said maintaining means comprises:

an elongated bracket having a centrally disposed longitudinal axis extending along a horizontal plane and further having opposed end portions connected to said flexible tubes respectively, each said bracket end portion having a substantially annular shape for receiving said distal tube end portions therein such that said flexible tubes can be moved laterally and outwardly away from said bracket when a user wishes to remove said apparatus from an operating position.

11. A hands-free apparatus for illuminating an area surrounding a user's body, said apparatus comprising:

a plurality of pliable and resiliently deformable tubes having removably matable proximal end portions and distal end portions positionable at a predetermined spatial relationship disposed forwardly of said proximal end portions, said tubes being adaptable between arcuate and linear shapes such that said apparatus can be adjustably positioned about a user's neck and supported thereon during operating conditions;

a replaceable power supply source internally situated within said flexible tubes, said power supply source including a protective cover having detachably mated first and second portions such that a user may readily access and replace the power supply source during repeated use;

a plurality of light-emitting sources connected to said flexible tubes and electrically coupled to said power supply source respectively, said light-emitting sources each comprising a switch operably connected to said power supply sources such that a user may independently toggle said light-emitting sources between operating and non-operating modes; and means for maintaining said distal end portions at the fixed spatial relationship after said flexible tubes are positioned about the user's neck such that a user may alter a position of said apparatus by moving the user's shoulders without the need to handle said flexible tubes, said maintaining means extending medially between said distal end portions and being positioned forwardly of the user's neck so that the user can visually identify a position of said distal end portions and quickly detach said flexible tubes from said maintaining means.

12. The apparatus of claim 11, wherein said light-emitting sources comprise:

a plurality of housings including a plurality of transparent lenses removably attached thereto for allowing a path of light to emanate outwardly from said apparatus, each said housing being selectively positionable distally of said maintaining means for allowing each said light-emitting sources to be independently angled along a plurality of quadrants.

13. The apparatus of claim 12, wherein said switches are connected to said housings and protrude upwardly therefrom respectively.

14. The apparatus of claim 12, wherein said switches are positioned distal to said maintaining means.

15. The apparatus of claim 11, wherein said maintaining means comprises:

an elongated bracket having a centrally disposed longitudinal axis extending along a horizontal plane and further having opposed end portions connected to said flexible tubes respectively, each said bracket end portion having a substantially annular shape for receiving said distal tube end portions therein such that said flexible tubes can be moved laterally and outwardly away from said bracket when a user wishes to remove said apparatus from an operating position.

* * * * *